United States Patent [19]

Campbell et al.

[11] Patent Number: 4,700,856

[45] Date of Patent: Oct. 20, 1987

[54] BABY BOTTLE WITH DISPOSABLE LINER

[76] Inventors: William O. Campbell; Nickie G. Campbell, both of 1107 W. Shawnee, Muskogee, Okla. 74402

[21] Appl. No.: 947,402

[22] Filed: Dec. 29, 1986

Related U.S. Application Data

[63] Continuation-in-part of Ser. No. 790,090, Oct. 22, 1985, which is a continuation of Ser. No. 597,388, Apr. 6, 1984, Pat. No. 4,570,808.

[51] Int. Cl.[4] ..... A61J 9/00; A61J 9/08; B65D 23/10

[52] U.S. Cl. ..... 215/11 E; 215/11 R; 215/11 C; 215/100 A; 220/94 A

[58] Field of Search ..... 215/1 R, 1 C, 11 R, 215/11 A–11 C, 100 A; D24/47, 48; D9/378, 380, 382, 383, 403, 372, 374; 220/94 A

[56] References Cited

U.S. PATENT DOCUMENTS

| | | | |
|---|---|---|---|
| D. 18,420 | 7/1888 | Geyer . | |
| D. 47,650 | 7/1915 | Roach . | |
| D. 71,125 | 9/1926 | Becker . | |
| D. 86,570 | 3/1932 | Humphreys . | |
| D. 92,518 | 6/1934 | Briner . | |
| D. 124,394 | 12/1940 | Service | D9/403 |
| D. 183,940 | 11/1958 | Luxardo et al. . | |
| D. 187,360 | 3/1960 | Hoffstein . | |
| D. 192,978 | 6/1962 | Garvey . | |
| D. 195,599 | 7/1963 | Platte et al. . | |
| D. 199,699 | 12/1964 | Dailey . | |
| D. 210,501 | 3/1968 | Brammer . | |
| D. 212,921 | 12/1968 | Bloomberg . | |
| D. 214,871 | 8/1969 | Tompkins . | |
| D. 216,248 | 12/1969 | Hills . | |
| D. 221,517 | 8/1971 | Luedtke . | |
| D. 224,200 | 7/1972 | Kretz . | |
| D. 229,723 | 12/1973 | Grimes . | |
| D. 239,697 | 4/1976 | Hunt . | |
| D. 240,968 | 8/1976 | Hurst . | |
| D. 273,276 | 4/1984 | Klim . | |
| D. 276,791 | 12/1984 | Field . | |
| D. 283,920 | 5/1986 | Chen . | |
| D. 284,220 | 6/1986 | Pote . | |
| 595,414 | 12/1897 | Roach . | |
| 1,037,309 | 9/1912 | Poore . | |
| 1,375,917 | 4/1921 | La Paugh . | |
| 1,617,213 | 2/1927 | La Paugh . | |
| 1,637,719 | 8/1927 | Whitlock . | |
| 1,668,227 | 5/1928 | Beck | 215/11 R |
| 1,947,753 | 2/1934 | Block | 215/11 R |
| 2,307,390 | 1/1943 | Chew . | |
| 2,588,069 | 3/1952 | Allen . | |
| 2,604,222 | 7/1952 | Teague et al. . | |
| 2,624,485 | 1/1953 | Boston . | |
| 2,722,086 | 11/1955 | Mullen . | |
| 2,789,002 | 4/1957 | Nicholas . | |
| 2,793,778 | 5/1957 | Maxwell . | |
| 2,831,596 | 4/1958 | Eyles . | |
| 2,843,281 | 7/1958 | Gallois . | |
| 2,859,891 | 11/1958 | Carkin | 215/11 E |
| 2,959,314 | 11/1960 | Sanchez . | |
| 2,978,131 | 4/1961 | Garvey . | |
| 2,986,296 | 5/1961 | Bannister et al. . | |
| 3,075,666 | 1/1963 | Hoffstein . | |
| 3,105,324 | 10/1963 | Friedman . | |

(List continued on next page.)

FOREIGN PATENT DOCUMENTS 0063033 10/1982 European Pat. Off. .

OTHER PUBLICATIONS

Supplemental Register Trademark, Reg. No. 727,833, (List continued on next page.)

*Primary Examiner*—William Price
*Assistant Examiner*—Sue A. Weaver
*Attorney, Agent, or Firm*—Staas & Halsey

[57] ABSTRACT

A baby bottle is described including an elongated container defining an area for receiving a disposable liner therein. Corresponding opposing recesses are formed longitudinally and substantially centrally in the container to form substantially tubular, elongated handles. An area of each handle is small enough for grasping by a baby's small hands, whereby the baby may independently support the bottle during feeding. Thereafter, the liner may be disposed and the bottle reused.

8 Claims, 6 Drawing Figures

U.S. PATENT DOCUMENTS 3,145,867 8/1964 Roberts et al. .
3,161,311 12/1964 Boston ..... 215/11 E
3,171,559 3/1965 Ferree .
3,195,752 7/1965 Cox .
3,232,495 2/1966 Schneider .
3,443,710 5/1969 Hills .
3,718,360 2/1973 Knutzen .
3,746,198 7/1973 Howland .
3,768,683 10/1973 Van den Bosch .
3,790,017 2/1974 Fitzpatrick et al. .
3,804,952 4/1974 MacDonald .
3,871,542 3/1975 Hammer .
3,931,886 1/1976 Yamauchi .
3,990,596 11/1976 Hoftman .
4,010,861 3/1977 Welten .
4,238,040 12/1980 Fitzpatrick .
4,339,046 7/1982 Coen .
4,526,274 7/1985 Kesselreing et al. .
4,533,057 8/1985 Klittich .
4,557,392 12/1985 Ryan et al. .
4,558,792 12/1985 Cabernoch et al. .
4,570,808 2/1986 Campbell et al. .

OTHER PUBLICATIONS

Registered 2/20/62, Nursing Bottles, The Pyramid Rubber Co., Ravenna, Ohio.
Feeding Bottles for Infants, TM Appln. No. 464,296, Gerber Products Company, Fremont, MI 49412.
Article from *Pediatrics* (vol. 6, 1898) entitled "The Feeding of Infants", by Dr. Nagel.

BABY BOTTLE WITH DISPOSABLE LINER

CROSS REFERENCES TO RELATED APPLICATIONS

This application is a continuation-in-part application of copending U.S. Ser. No. 790,090 filed Oct. 22, 1985, which is a continuation of U.S. Ser. No. 597,388 filed Apr. 6, 1984, now U.S. Pat. No. 4,570,808.

Two design patent applications were filed on Oct. 30, 1986 related to the present invention. These two applications have been assigned U.S. Ser. Nos. 925,392 and 925,393, respectively.

BACKGROUND OF THE INVENTION

This invention relates to a baby bottle and, more particularly, to a baby bottle having a disposable liner and being configured for ease of holding by an infant during feeding.

Conventional baby bottles are of a generally cylindrical configuration and are designed to contain and dispense a certain quantity of liquid. The liquid can be received in the baby bottle in either of two ways: (1) by a closed-end bottle, as evidenced by U.S. Pat. No. 3,746,198; or (2) by a disposable liner received within a bottle, as evidenced by U.S. Pat. No. 3,075,066.

The above-discussed closed-end bottle has been known for quite some time and is still quite popular. On the other hand, the disposable liner type is more recent and is characterized by improved convenience and hygiene.

Either of these types of baby bottles necessarily has an outer circumference larger than that easily surrounded by the small hands of the baby. As a result, it is difficult for the baby to support the bottle during feeding. This is a disadvantage in that an attendant is usually required to hold the bottle and feed the baby.

Attempts to overcome this disadvantage have been made, as shown in U.S. Pat. No. 595,414, issued to ROACH. ROACH discloses a baby bottle having a semicircular opening extending entirely through the upper body of the bottle. The opening is intended specifically to receive a nipple attachment to preclude loss or swallowing of the nipple by the baby. As a coincidental benefit, the opening creates handles to facilitate holding of the bottle by the baby.

EPC published patent application No. 0063033, of McFARLANE, shows a substantially triangular cross section baby bottle including a disposable liner, each side of the bottle being indented and the edges being rounded. Although this bottle attempts to combine the benefits of a disposable liner and a shape which is intended to be held by a child, this bottle has not proved very easy for the baby to hold.

In light of the convenience and improved hygiene associated with baby bottles having disposable liners, it is desired to have a baby bottle which is very easy for a baby to hold and which can incorporate a disposable liner.

SUMMARY OF THE INVENTION

Accordingly it is an object of the present invention to provide a baby bottle that can be easily held by a baby and that is adapted to receive a disposable liner.

It is also an object of the present invention to provide an easier to hold baby bottle with a disposable liner which is easy to assemble, use and disassemble and promotes hygiene.

To achieve the foregoing and other objects of the present invention and in accordance with the purposes of the invention there is provided a baby bottle having a body with corresponding opposing, elongated recesses formed therein. The recesses effectively form spaced oppositely disposed, substantially tubular handles. In addition, a disposable liner is received by the body of the bottle. This baby bottle can be easily grasped and supported by a baby without assistance during feeding, the liner can be conveniently disposed of after feeding, and overall hygiene is improved.

DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
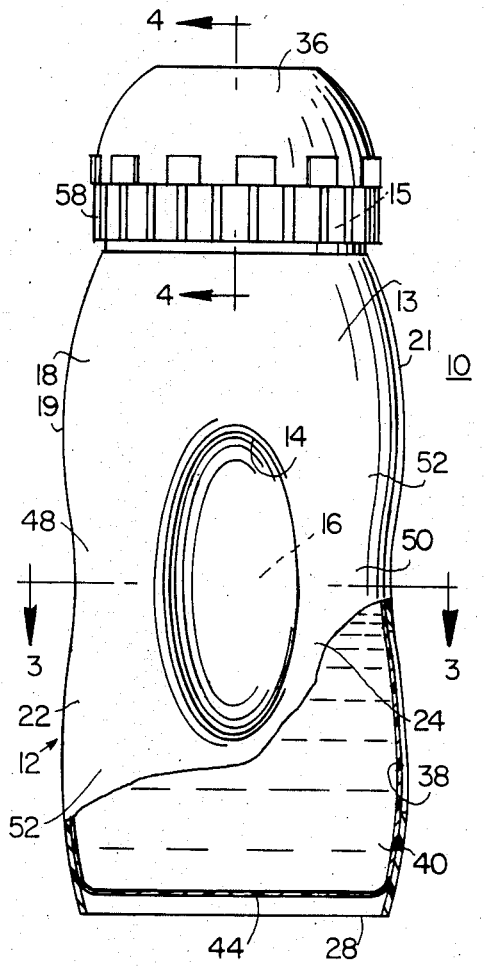
FIG. 1 is a front, partial cross-sectional, elevational view of the baby bottle according to the present invention.
Figure 2:
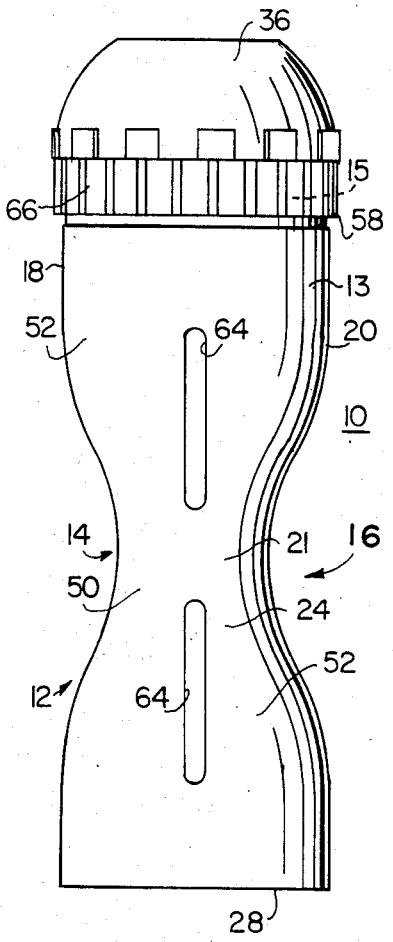
FIG. 2 is a right side view of the baby bottle shown in FIG. 1.
Figure 3:
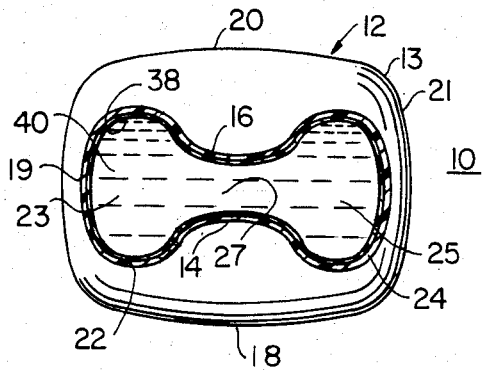
FIG. 3 is a cross-sectional view taken along line 3—3 of FIG. 1.

Referring to the drawings herein, reference character 10 generally indicates the baby bottle according to the present invention. This baby bottle 10 includes an elongated container 12 which defines a space 26 for receiving a disposable liner 38 as described below. The container 12 generally includes a body portion 13 and a neck portion 15. The container 12 also is defined by a front 18, a left side 19, a back 20, a right side 21, an open bottom 28 and an open top 30 terminating the neck portion 15.

In the body portion 13 there are formed first and second, corresponding, opposing recesses 14 and 16, respectively, between the front 18, left side 19, back 20 and right side 21. The opposing recesses 14 and 16 are preferably elongated oval or elliptical shapes and effectively form at least one but preferably a pair of separate, elongated, substantially tubular portions or handles 22 and 24 at the left side 19 and the right side 21, respectively. The interiors 23 and 25 of the handles 22 and 24, respectively, are in open communication with an area 27 remaining between the opposing, separated recesses 14 and 16.

Each handle 22, 24 preferably includes portions 48, 50 respectively, which are of a smaller cross-section than at least one of the end portions 52 of the handles 22, 24, thus providing a tapered configuration for the outer periphery of each handle 22, 24. The reduced cross-section portions 48 and 50 are preferably disposed adjacent the longitudinal center of the opposing recesses 14 and 16. In this way, the child's tiny hands are effectively guided to the area of a full bottle where the center of gravity generally exists, thereby further facilitating grasping and supporting by the baby.

The body 13 is preferably made of a suitable, non-toxic material such as clear polycarbonate or high density polyethylene, either natural or colored, and is about three or four hundredths of an inch thick. When colored, high density polyethylene is used, windows 64 may be formed in the body 13 to allow one to view the quantity of liquid 40 remaining or otherwise to see into the bottle 10.

The top 30 removably receives a nipple 32, a ring 34 and a dome-like cap 36 thereon, as discussed more fully below. Each of the ring 34 and cap 36 is also preferably made from a clear polycarbonate or high density polyethylene which can be natural or colored, whereas the nipple 32 is preferably made from a clear silicon or dipped latex.

The area 26 defined by the container 12 easily accommodates a sterilized, substantially cylindrical, disposable liner 38. The liner 38 has an open end 42 and a closed end 44 for receiving a liquid 40, such as milk or juice.

Figure 4:
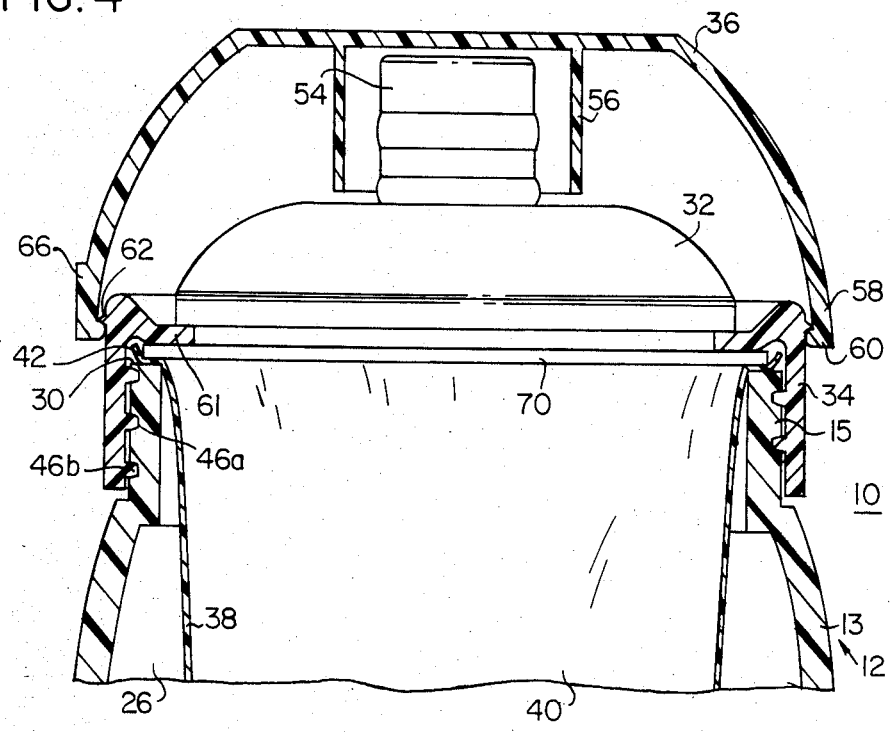
FIG. 4 is a partial cross-sectional view of the baby bottle according to the present invention.
Figure 5:
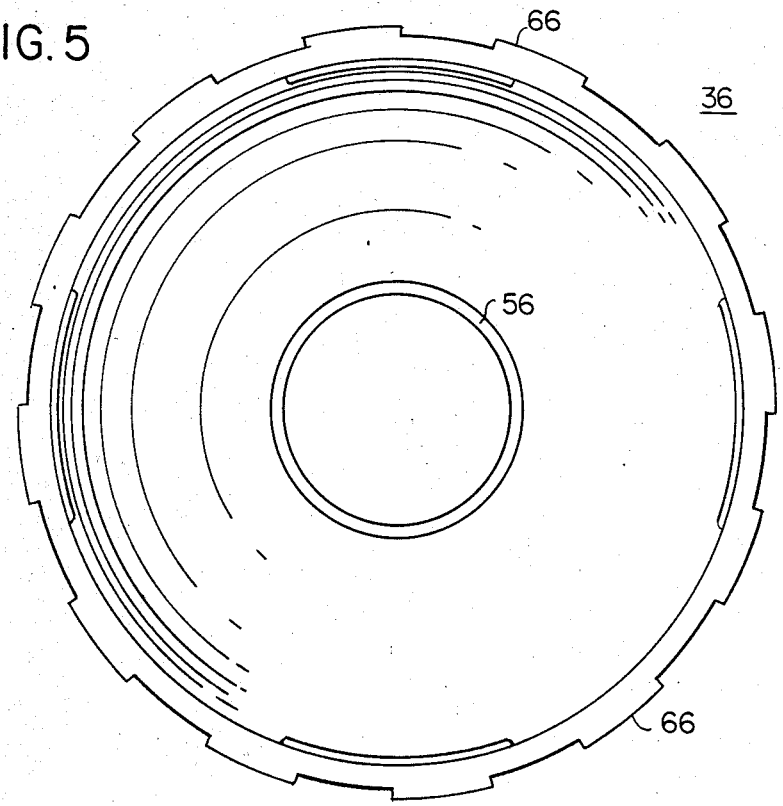
FIG. 5 is a top plan view of the baby bottle according to the present invention.

The cap 36 is shown in detail in FIGS. 4 and 5. As seen, a projecting portion 54 of the nipple 32 is neatly received within a cylindrical receptacle 56 formed on the underside of the cap 36. In addition, inside the lower edge 58 of the cap 36 there is formed a circumferential lip 60 which creates an interference fit with a circumferential projection 62 formed on the outside of the ring 34 when the cap 36 is pushed onto the ring 34. Further, the cap 36 includes a plurality of radial projections 66 formed externally on the lower edge 58 thereof to facilitate removal and installation of the cap 36, even if the cap 36 becomes wet. The cap 36, when installed, keeps the nipple 32 free of debris if the bottle 10 should be dropped.

As also shown in FIG. 4, the neck portion 15 includes external threads **46*a* which combine with internal threads 46*b* formed on the ring 34 to attach the ring 34 to the neck portion 15. Further, the open end 42 of the liner 38 is fixedly received between the top 30 on the neck portion 15, the base 70 of the nipple 32 and the upper area 61 of the ring 34. The disposable liner 38 extends into the body 13 of the container 12 and, along with the above-described arrangement of the nipple 32 and ring 34, contain the liquid 40** in a relatively leak-proof manner.

Figure 6:
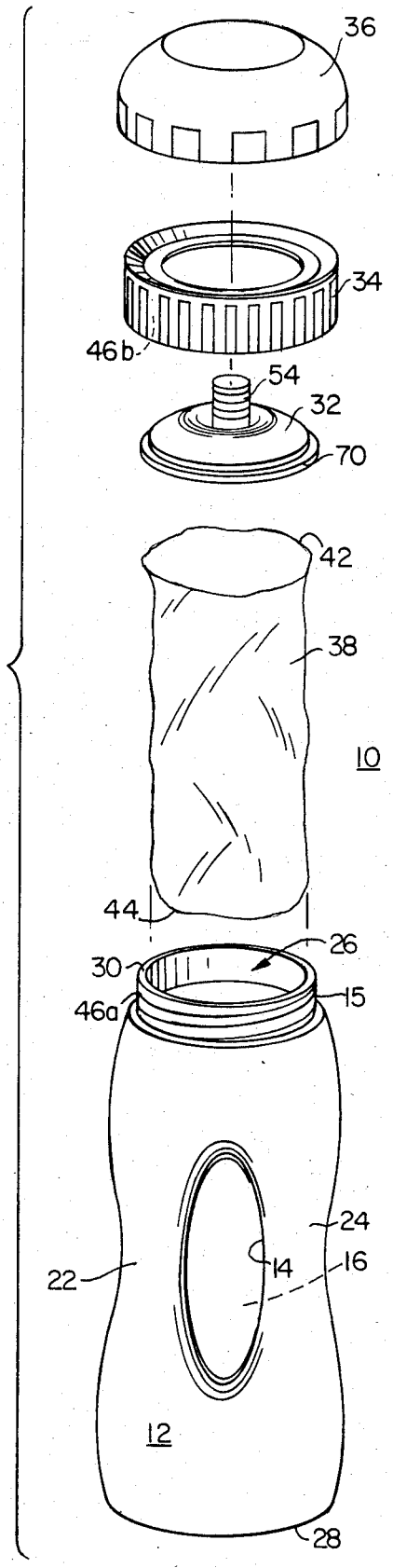
FIG. 6 is an exploded view of the baby bottle according to the present invention.

FIG. 6 is an exploded view of the assembly of the baby bottle 10 according to the present invention. As seen, the closed end 44 of the disposable liner 38 is inserted into the neck portion 15 of the container 12. The open end 42 of the liner 38 is then folded over the top 30 on the neck portion 15 and the liner 38 is partially filled with liquid 40 while the open end 42 is held in place. The ring 34 receiving the nipple 32 therein is then screwed onto the neck portion 15 of the container 12 to capture the open end 42 of the liner 38 between the base 70 of the nipple 32 and the top 30 on the neck portion 15. If desired, the cap 36 is then placed on the ring 34 via the interference fit described above. After use, the liner 38 can be disposed of and the remainder of the baby bottle components re-used.

The opposing recesses 14 and 16 which form the handles 22 and 24 provide a bottle 10 which may be readily grasped by the small hands of a baby, whereby the baby may hold or support its own bottle during feeding. The baby may grasp either a single handle, or may grasp a handle in each of its hands, as desired, thus greatly facilitating the feeding of the baby by releasing an attendant from constantly assisting the baby during feeding. This is not only of assistance to the attendant, but also may give the baby a sense of well being.

As a result, the baby bottle according to the present invention is superior to that described in the European application No. 0063033 to McFARLANE. That is, the three edges of the McFARLANE bottle are rounded but expand inwardly. The edges, therefore, are too large for a small baby's hands to grasp easily. In addition, the three-edge configuration of McFARLANE casues the child to choose two edges for holding, which two edges are necessarily at a 120° angle to each other. This structure also complicates the child's attempt to grasp the edges. As a practical matter, the McFARLANE design induces a child's hands to lose grip because the edges are more like angled ramps than handles. In contrast, the two handles of the present invention are substantially tubular and oppose each other co-linearly at a convenient distance. Since each handle has an almost circular cross-section, the baby's fingers and thumb can surround the handle in a natural manner to attain a proper, comfortable grasp throughout feeding.

The components of the baby bottle 10 of the present invention may be fabricated from different materials, as suggested above. Almost any combination of colored and clear materials may be used as desired. For example, contrasting combinations of a clear container with colored components provide an aesthetically pleasing baby bottle from a marketing standpoint, while also allowing the user to view the interior of the baby bottle and more particularly, the cleanliness thereof, which, of course, is a distinct functional advantage.

Overall, the present invention provides a novel baby bottle receiving a sterilized plastic liner and being particularly configured to be easily held by a baby. That is, the baby may grasp and support the bottle and be fully independent of outside assistance during feeding.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention and the appended claims.

We claim:

1. A baby bottle, comprising:

a container defining a continuous space and having (a) a body portion;

(b) an open neck portion capable of receiving a nipple means thereon;

(c) a pair of corresponding, opposing recesses formed in the body portion creating two substantially tubular handles; and (d) a liner extending into the space defined by the container and having an open end positioned between the neck portion and the nipple means, wherein the substantially tubular handles can be grasped by a baby to support the container during feeding.

2. The baby bottle as recited in claim 1, wherein the container is elongated, the opposing recesses are elliptical in shape and extend longitudinally in the container and the handles are elongated.

3. The baby bottle as recited in claim 2, wherein each of the two handles has a first area with a first, crosssectional dimension in the vicinity of the opposing recesses which is smaller than a second cross-sectional dimension thereof in the vicinity of the recesses.

4. The baby bottle as recited in claim 3, wherein the body portion further comprises an open bottom.

5. The baby bottle as recited in claim 4, wherein the body portion is clear to allow viewing of the space defined by the container.

6. The baby bottle as recited in claim 5, wherein the nipple means comprises a ring for securing a nipple to the neck portion and a cap adapted for removable attachment to the ring.

7. A baby bottle, comprising a container defining a continuous space and having—

(a) an elongated body portion with an open bottom;

(b) an open neck portion capable of receiving a nipple and ring thereon;

(c) a pair of corresponding, opposing recesses formed longitudinally in the body portion, the pair of recesses creating two elongated, substantially tubular handles, wherein each of the two handles has a first area with a first, cross-sectional dimension in the vincinity of the opposing recesses which is smaller than a second cross-ssectional dimension thereof in the vicinity of the recesses;

(d) a liner with a closed end and an open end, the closed end extending into the continuous space and the open end being positioned between the neck portion and the nipple by the ring; and wherein, the two handles can be grasped by a baby to support the container during feeding.

8. The baby bottle as recited in claim 7, further comprising a cap for removable attachment to the ring.

* * * * *